US009233453B1

(12) United States Patent
Samuels et al.

(10) Patent No.: US 9,233,453 B1
(45) Date of Patent: Jan. 12, 2016

(54) APPARATUSES AND METHODS FOR SERIAL SECTIONING AND IMAGING

(71) Applicant: Situ Studio, Brooklyn, NY (US)

(72) Inventors: Bradley Samuels, Brooklyn, NY (US); Kenneth W. Kellerson, Caledonia, NY (US); Basar Girit, Ridgewood, NY (US); Aleksey Lukyanov, Brooklyn, NY (US); Adam Maloof, Hopewell, NJ (US); Westley Rozen, Brooklyn, NY (US)

(73) Assignee: Situ Studio, Brooklyn, NY (US)

( * ) Notice: Subject to any disclaimer, the term of this patent is extended or adjusted under 35 U.S.C. 154(b) by 421 days.

(21) Appl. No.: 13/841,933

(22) Filed: Mar. 15, 2013

Related U.S. Application Data

(60) Provisional application No. 61/617,559, filed on Mar. 29, 2012.

(51) Int. Cl.
*B24B 49/12* (2006.01)

(52) U.S. Cl.
CPC ..... *B24B 49/12* (2013.01)

(58) Field of Classification Search
CPC . G01N 1/286; G01N 1/06; G01N 2001/2873; G01N 2203/0647; G02B 21/26; G02B 21/367
USPC ..... 451/5, 6, 8, 11, 41, 285–290; 700/118, 700/159, 182
See application file for complete search history.

(56) References Cited

U.S. PATENT DOCUMENTS

| | | | | |
|---|---|---|---|---|
| 3,649,108 | A | 3/1972 | Ahrens et al. | |
| 5,139,338 | A | 8/1992 | Pomerantz et al. | |
| 7,317,964 | B1 * | 1/2008 | Spowart et al. | 700/182 |
| 7,319,915 | B1 | 1/2008 | Spowart et al. | |
| 2002/0081015 | A1 * | 6/2002 | Alkemper et al. | 382/141 |
| 2003/0184730 | A1 * | 10/2003 | Price | 356/39 |
| 2009/0088047 | A1 * | 4/2009 | Zurbuchen | 451/6 |

OTHER PUBLICATIONS

Lawrence, J., et al., "Optical Sectioning of Microbial Biofilms", in Journal of Bacteriology, vol. 173, Aug. 1991, pp. 6558-6567.
Sutton, M., "Tomographic Techniques for the Study of Exceptionally Preserved Fossils", in the Proceedings of the Royal Society, Jul. 2008, pp. 1587-1593.

(Continued)

*Primary Examiner* — Robert Rose
(74) *Attorney, Agent, or Firm* — Byrne Poh LLP

(57) ABSTRACT

In some embodiments, an apparatus comprises: a stage moveable on first and second axes; a material removal tool moveable on a third axis; a linear slide and a guide parallel to the third axis; a mount for an imaging device coupled to the linear slide using carriages; an armature coupled to the material removal tool and the guide that moves the guide along the third axis with the tool; a locking device for fixing the mount along the guide; and a processor that: (a) move a sample to a material removal position; (b) cause the tool to remove a first thickness of the sample along the third axis; (c) move the sample to an imaging position located at a predetermined location with respect to the mounting block; and repeating (a) through (c) until a second thickness of the sample has been removed.

20 Claims, 6 Drawing Sheets

(56) References Cited

OTHER PUBLICATIONS

Sutton, M., et al., "Methodologies for the Visualization and Reconstruction of Three-Dimensional Fossils from the Silurian Herefordshire Lagerstatte", In Palaeontol. Electron., vol. 4, Jun. 2001, pp. 1-17.

Watters, W. And Grotzinger, J., "Digital Reconstruction of Calcified Early Metazoans Terminal Proterozoic Nama Group, Namibia", In Paleobiology, vol. 27, 2001 (month unknown), pp. 159-171.

* cited by examiner

APPARATUSES AND METHODS FOR SERIAL SECTIONING AND IMAGING

CROSS-REFERENCE TO RELATED APPLICATION

This application claims the benefit of U.S. Provisional Patent Application No. 61/617,559, filed Mar. 29, 2012, which is hereby incorporated by reference herein in its entirety.

STATEMENT REGARDING FEDERALLY SPONSORED RESEARCH OR DEVELOPMENT

This invention was made with government support under Award No. 1028768 awarded by the National Science Foundation (NSF). The government has certain rights in the invention.

TECHNICAL FIELD

The disclosed subject matter relates to apparatuses and methods for serial sectioning and imaging.

BACKGROUND

Scientists and others are often interested in determining features of a sample of material that are inaccessible by merely examining the surface of the sample. For example, a sample may contain: fossils, mineral deposits, fracturing, vesicles and/or other microscopic and macroscopic features that a scientist may be interested in observing in greater detail. For example, a scientist may be interested, in the three-dimensional structure or a three-dimensional spatial distribution of features of the sample. There are generally non-destructive and destructive techniques for examining otherwise inaccessible features of a sample. For example, non-destructive techniques can include X-ray imaging such as X-ray computed tomography (CT) and X-ray microscopy techniques that can be used to determine some interior features of samples. However, these techniques are generally limited in their ability to differentiate between objects of similar density and/or similar mineralogy, among other shortcomings.

Destructive techniques, on the other hand, are often time consuming and imprecise when performed manually, or limited to examining only a limited field of view of microstructure in a sample when performed automatically.

Accordingly, new apparatuses and methods for serial sectioning are desirable.

SUMMARY

Apparatuses and methods for serial sectioning and imaging are provided. In accordance with some embodiments of the disclosed subject matter, apparatuses for serial sectioning and imaging are provided, the apparatuses comprising: An apparatus for serial sectioning, the apparatus comprising: a material removal tool moveable on a first axis; a bed moveable on a second axis and third axis, wherein the first axis and second axis are perpendicular, and wherein the third axis is perpendicular to both the first axis and second axis; a linear slide positioned substantially parallel to the first axis; a guide positioned substantially parallel to the first axis; a mounting block configured to be coupled to an imaging device, the mounting block coupled to the linear slide using one or more carriages; an armature coupled to the material removal tool and the guide, such that the guide moves along a direction parallel to the first axis in a fixed relationship with the material removal tool; a locking device that fixes a position of the mounting block at a particular location along the length of the guide; and a hardware processor that is configured to: (a) cause the bed to be moved to a material removal position in a plane defined by the second axis and third axis; (b) cause the material removal tool to remove a first predetermined thickness of a sample mounted to the sample table along the first axis; (c) cause the bed to be moved to an imaging position in the plane defined by the first axis and second axis such that the center of the bed is located at a predetermined location with respect to the mounting block; and (d) repeating (a) through (c) until a second predetermined thickness of the sample has been removed.

In accordance with some embodiments of the disclosed subject matter, methods for serial sectioning and imaging are provided, the methods comprising: (a) fixing a position of an imaging device along a first axis defined by a guide based on a working distance of the imaging device, wherein the guide is coupled to a material removal tool; (b) fixing a distance between the imaging device and a surface of a sample; (c) causing, using at least one hardware processor, the sample to be moved to a material removal position in a plane defined by a second axis and a third axis that are both perpendicular to the first axis; (d) causing, using the at least one hardware processor, the material removal tool to remove a first predetermined thickness of the sample along a first axis direction; (e) causing, using the at least one hardware processor, the sample stage to be moved to an imaging position in the plane defined by the second axis and third axis such that the center of the sample is located at a predetermined location with respect to the imaging device; (f) causing, using the at least one hardware processor, the imaging device to capture an image of a newly revealed surface of the sample; (g) repeating (c) through (f) until a second predetermined thickness of the sample has been removed.

BRIEF DESCRIPTION OF THE DRAWINGS

Various objects, features, and advantages of the disclosed subject matter can be more fully appreciated with reference to the following detailed description of the disclosed subject matter when considered in connection with the following drawings, in which like reference numerals identify like elements.

DETAILED DESCRIPTION

Figure 1:
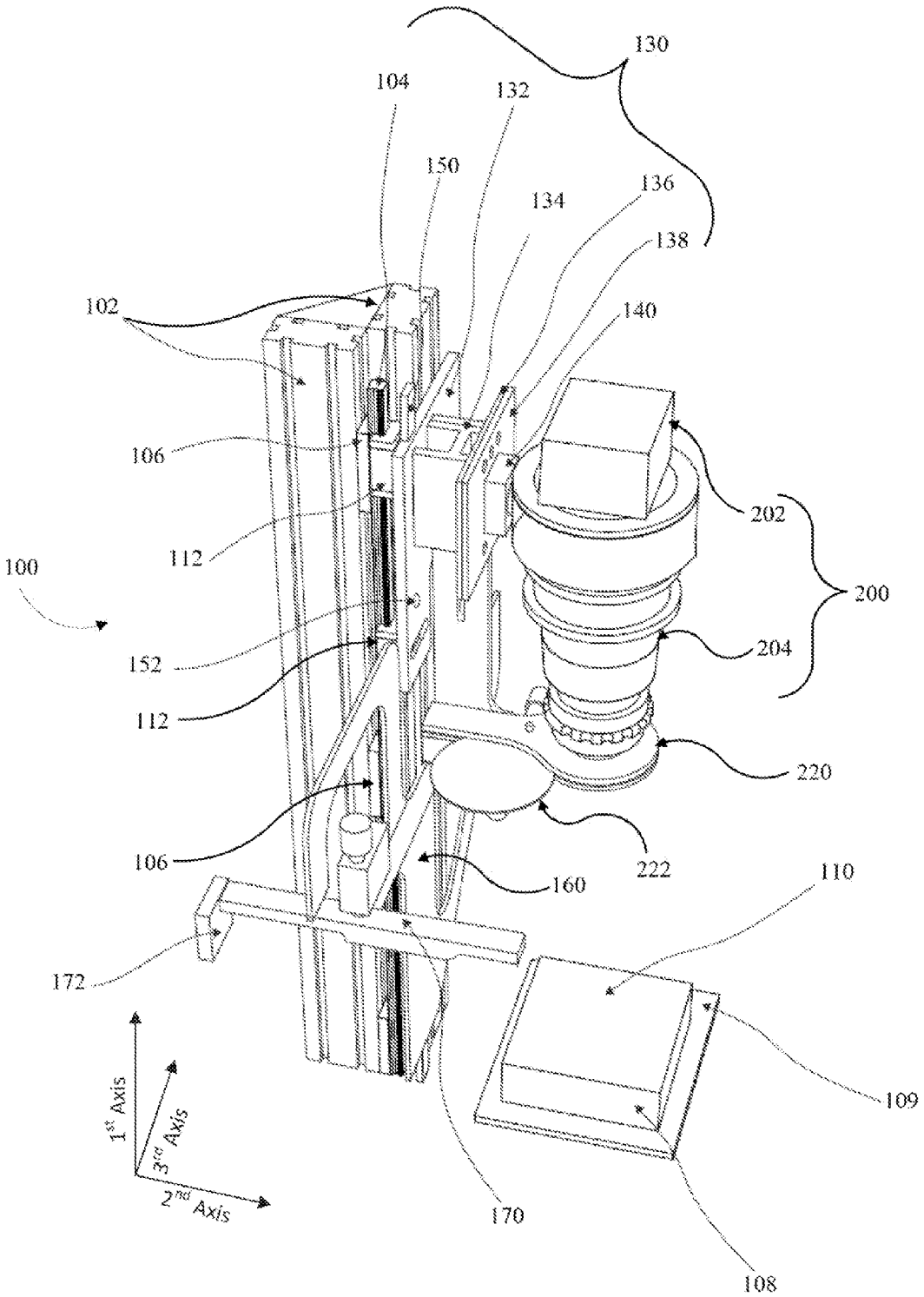
FIG. 1 shows an example of a perspective view of an imaging assembly in accordance with some embodiments of the disclosed subject matter.

Apparatuses and methods for serial sectioning and imaging are provided. In accordance with various embodiments, mechanisms which can include apparatuses and methods for serial sectioning and imaging are provided.

In some embodiments, mechanisms for serial sectioning and imaging can be used to capture images of a surface of a sample, such as stone (e.g., composed of minerals), metals, alloys, concrete, organic matter, or any other suitable material, as surface layers of the sample are successively removed. A sample may sometimes be referred to as a specimen. Information from these captured images can be used to create a three-dimensional reconstruction of the sample, and can include both macroscopic features of the sample, as well as microscopic features of the sample.

In some embodiments, a serial sectioning apparatus can include a computer numerical control (CNC) material removal tool such as a surface grinder, which can be used to successively remove thin layers of material from the sample (e.g., layers on the order of microns). After a predetermined thickness of material is removed, in some embodiments, an imaging device such as a Medium Format image sensor can be used to capture an image of the surface using a lens that projects a macro image (e.g., an image with a ratio of at least one to one between the image and the object that is the subject of the image) on an image sensor. This is merely an example, and any suitable image sensor (such as image sensors sensitive to visible light, infrared light, high energy radiation such as X-rays, gamma rays, etc.) and/or lens combination can be used to capture an image of the sample.

In some embodiments, a position of the imaging device with respect to a surface of the sample to be imaged can be determined prior to performing sectioning and imaging of the sample using the mechanisms described herein. For example, if the imaging device includes an image sensor and a lens, the imaging device can be positioned at an appropriate distance from the sample and/or the lens can be adjusted to provide a properly focused image on the image sensor. An appropriate distance between the imaging device and the surface of the sample is sometimes referred to herein as a working distance.

In some embodiments, a working distance can be maintained between the imaging device and the surface of the sample as the thickness of the sample is reduced by the serial sectioning apparatus. This distance can be maintained by coupling the imaging device to the serial sectioning apparatus by a mechanical link that allows movement of a surface grinder (or other material removal tool) in a first axis direction to be translated to the imaging device, which can be configured to move freely along a slide that is also coupled to the serial sectioning apparatus. This can allow the imaging device to move synchronously with the level of the surface grinder as it successively removes layers of the sample, which can keep the imaging device a substantially constant distance from the sample surface after each successive layer is removed.

FIG. 1 shows an example of a perspective view of an imaging assembly 100 for a serial sectioning and imaging apparatus in accordance with some embodiments of the disclosed subject matter. As illustrated, imaging assembly 100 can include a rail 102 for supporting and/or aligning other components of imaging assembly 100 with respect to a serial sectioning device. Rail 102 can include one or more rails of any suitable construction. For example, rail 102 can be comprised of metal extrusions with grooves for coupling components. In a more particular example, rail 102 can include extruded aluminum rails coupled to one another with steel brackets. In some embodiments, rail 102 can be coupled to a serial sectioning apparatus, as described below in connection with FIG. 4.

In some embodiments, a linear slide 104 can be coupled to rail 102. Linear slide 104 can be any suitable hardware that enables linear movement of a camera assembly along the same axis as a sectioning axis of the serial sectioning apparatus (e.g., the first axis). For example, linear slide 104 can include one or more exterior grooves along which a carriage, or the like, can move along the length of linear slide 104. As another example, linear slide 104 can include one or more interior grooves along which a carriage, or the like, can move along the length of linear slide 104. As yet another example, linear slide 104 can include exterior surfaces along which a carriage, or the like, can move along the length of linear slide 104. These examples are given for illustrative purposes, and are not intended to be limiting.

In some embodiments, linear slide 104 can be coupled to rail 102 using one or more slide brackets 106. Slide brackets 106 can be secured to rail 102 and slide 104 using any suitable technique(s). By coupling the linear rail to slide brackets 106 and coupling slide brackets 106 to rail 102 independently, the position of slide brackets 106 can be adjusted to ensure that linear slide 104 is substantially perpendicular to a top surface 110 of a sample 108 that is subject to a serial sectioning process. In some embodiments, sample 108 can be secured to a sample mounting plate 109, as described below in connection with FIG. 4.

In some embodiments, a tram and a leveling block can be used to align slide brackets 106 and/or linear slide 104 such that an axis of linear slide 104 and a plane of top face 110 of sample 108 are substantially perpendicular. After aligning slide brackets 106, hardware used to couple slide brackets 106 to linear slide 104 and/or rail 102 can be tightened to maintain the alignment between linear slide 104 and top surface 110. This perpendicular alignment relationship can be maintained with any suitable degree of accuracy. In one particular example, the alignment of linear slide 104 to top surface can be set within 2.5 micrometers (sometimes written as microns, μ, or μm herein) of perpendicular at over the entire length of linear slide 104, although this is just an example and any suitable degree of accuracy can be used.

In some embodiments, camera mounting assembly 130 can be coupled to linear slide 104 using one or more carriages 112 which can move along the length of linear slide 104. Each carriage 112 can include any suitable components for providing movement along linear slide 104. For example, carriage 112 can include ball bearings or roller bearings that provide points of contact between carriage 112 and a groove and/or surface of linear slide 104. As a more particular example, linear slide 104 and carriage 112 can include a 500 Series Ball Spacer Linear Guide available from Thomson Linear, a brand of Danaher Motion of Wood Dale, Ill.

In some embodiments, camera mounting assembly 130 can include a carriage plate 132 coupled to one or more carriages 112, which can allow movement of carriage plate 132, and hence camera mounting assembly 130, along the length of linear slide 104. In some embodiments, carriage plate 132 can be a steel plate machined to form appropriate connection points, or the like, for connection to one or more carriages 112 and other components of camera mounting assembly 130.

In some embodiments, as shown in FIG. 1, camera mounting assembly 130 can further include a mount neck 134. A first end of mount neck 134 can be coupled to carriage plate 132 such that mount neck 134 extends perpendicular to a surface of carriage plate 132. The first side of mount neck 134 can be coupled to carriage plate 132 using any suitable technique(s), such as by welding, with fasteners, etc. Mount neck 134 can have any suitable dimensions such that an imaging axis of an imaging device (such as a camera) can be disposed over an imaging position of sample 108.

In some embodiments, a mounting plate can be coupled to a second side of mount neck 134. As illustrated in FIG. 1, the mounting plate can include a rear mount plate 136 and a front mount plate 138. Rear mount plate 136 can be coupled to mount neck 134 using any suitable techniques (e.g., welding, using fasteners, etc.).

In some embodiments, front mount plate 138 can be coupled to rear mount plate 136 such that a relative position between rear mount plate 136 and front mount plate 138 can be adjusted. For example, front mount plate 138 can be coupled to rear mount plate 136 using a mechanical connection, whereby a front mount plate key (not shown) can be loosened to allow movement between the rear mount plate 136 and front mount plate 138. Such a front mount plate key can be tightened to fix and/or lock a relationship of front mount plate 138 and rear mount plate 136 with respect to each other. In some embodiments, the relationship between front mount plate 138 and rear mount plate 136 can be changed to adjust a position and/or orientation of an imaging device with respect to a sample. Additionally, these adjustments can be fine adjustments (e.g., on the order of microns) and can be made using a tram, or the like.

In some embodiments, a mount 140 can be coupled to front mount plate 138 for mounting an imaging device to be used with imaging assembly 100. In some embodiments, mount 140 can include at least two parts, a first side of mount 140 can be coupled to front mount plate 138, and the first side can be configured to receive a second side of mount 140 that is coupled to an imager. Any suitable mounting techniques can be used in mount 140 for mounting the imaging device. For example, a mount that allows for an imaging device, such as a camera, to be attached and detached from camera mounting assembly 130 without tools can be used. In a more particular example, the first side of mount 140 can include a female dovetail that is configured to receive a male dovetail, and the second side of mount 140 can include a corresponding male dovetail. In another particular example, mount 140 can include a female side and a male side of a bayonet-type mount, or the like.

In a more particular example, the male dovetail and the female dovetail can be loosely fit and it can be determined whether an imaging axis of the imager (e.g., an optical axis of a camera) is at a proper angle with respect to top surface 110 of sample 108. When it is determined that a position of the imaging device is properly aligned with top surface 110 of sample 108, the position of the imaging device can be fixed by fixing the relationship of front mount plate 138 and rear mount plate 136 (as described above) and/or by fixing a position of the female dovetail-male dovetail connection.

In some embodiments, a distance between top surface 110 and mount 140 can be adjusted using a guide 150. Guide 150 can be disposed parallel to slide 104 and can be coupled to carriage plate 132 by a dado (e.g., a groove) in one side of carriage plate 132. A position of carriage plate 132, and therefore of camera mounting assembly 130, along guide 150 can be fixed using a positioning pin 152 disposed through a portion of carriage plate 132. Positioning pin 152 can include any suitable hardware for fixing a position of carriage plate 132 with respect to guide 150. For example, guide 150 can include set holes into which positioning pin 152 can be inserted. In such an example, positioning pin 152 can be threaded (e.g., positioning pin 152 can be a threaded screw, bolt, etc.) that can be received by suitable threading in the set holes of guide 150. Alternatively, positioning pin 152 can be substantially smooth and can be inserted into set holes of guide 150 and maintained in position by a bias (e.g., a spring, gravity, etc.). As another example, guide 150 may not include set holes, and a position of carriage plate 132 can be maintained by positioning pin 152 causing a position of carriage plate 132 along guide 150 to be fixed by friction. As different imaging devices may be coupled to mount 140, and these different imaging devices may have different working distances (e.g., focal lengths, or the like) from sample 108, positioning of carriage plate 132 at different points along guide 150 allows for different imaging devices with different working distances to be used without otherwise changing the construction of camera mounting assembly 130.

In some embodiments, guide 150 can be coupled to a translational armature 160. Any suitable technique(s) can be used to couple guide 150 and translational armature 160. For example, guide 150 can be secured in a slot(s) of translational armature 160. Translational armature 160 can in turn be coupled to the serial sectioning apparatus such that movement of the serial sectioning apparatus in a direction parallel to an axis of linear slide 104 (e.g., moving in a first axis direction) causes a corresponding movement of guide 150 of the same magnitude in the same direction. The axis of linear slide 104 is sometimes referred to herein as a first axis direction for ease of explanation, and is not intended to denote a direction with respect to gravity or any other fixed frame of reference. As described above, a position of camera mounting assembly 130 can be fixed with respect to guide 150. Therefore, translational armature 160 can translate motion of the serial sectioning apparatus (in a first axis direction) to camera mounting assembly 130, by the fixed relationship of guide 150 and carriage plate 132.

In some embodiments, translational armature 160 can be coupled to linear slide 104 by one or more carriages 112 (not shown), which can be similar in construction to carriages 112 coupled to carriage plate 132. Additionally, translational armature 160 can be coupled to a serial sectioning apparatus by a translational bridge (described in connection with FIG. 3), and a track 170. Track 170 can be coupled to a spindle housing and/or a wheel housing (described below in connection with FIG. 4), or the like, of the serial sectioning device by one or more spacers 172, such that a position of track 170 with respect to the spindle housing and/or wheel housing is fixed. For example, movement of track 170 can be in the same direction and of the same magnitude as movement of the spindle housing and/or wheel housing, such that as the spindle housing and/or wheel housing moves in first axis direction, track 170 moves in the same direction and moves the same amount.

In some embodiments, a connection between the translational bridge and track 170 can be made through a bearing, a carriage, or the like, such that, track 170 can move in a direction perpendicular to the first axis direction (e.g., in a second axis direction) under the translational bridge without movement in the same direction of the translational bridge. In cases where the spindle housing and/or wheel housing can move in two-dimensions (e.g., in both the second axis direction and a third axis direction), an additional track can be used such that the spindle housing and/or wheel housing can move in the plane defined by the second axis and third axis without movement of the translational bridge or translational armature 160 in the second axis-third axis plane.

Figure 2:
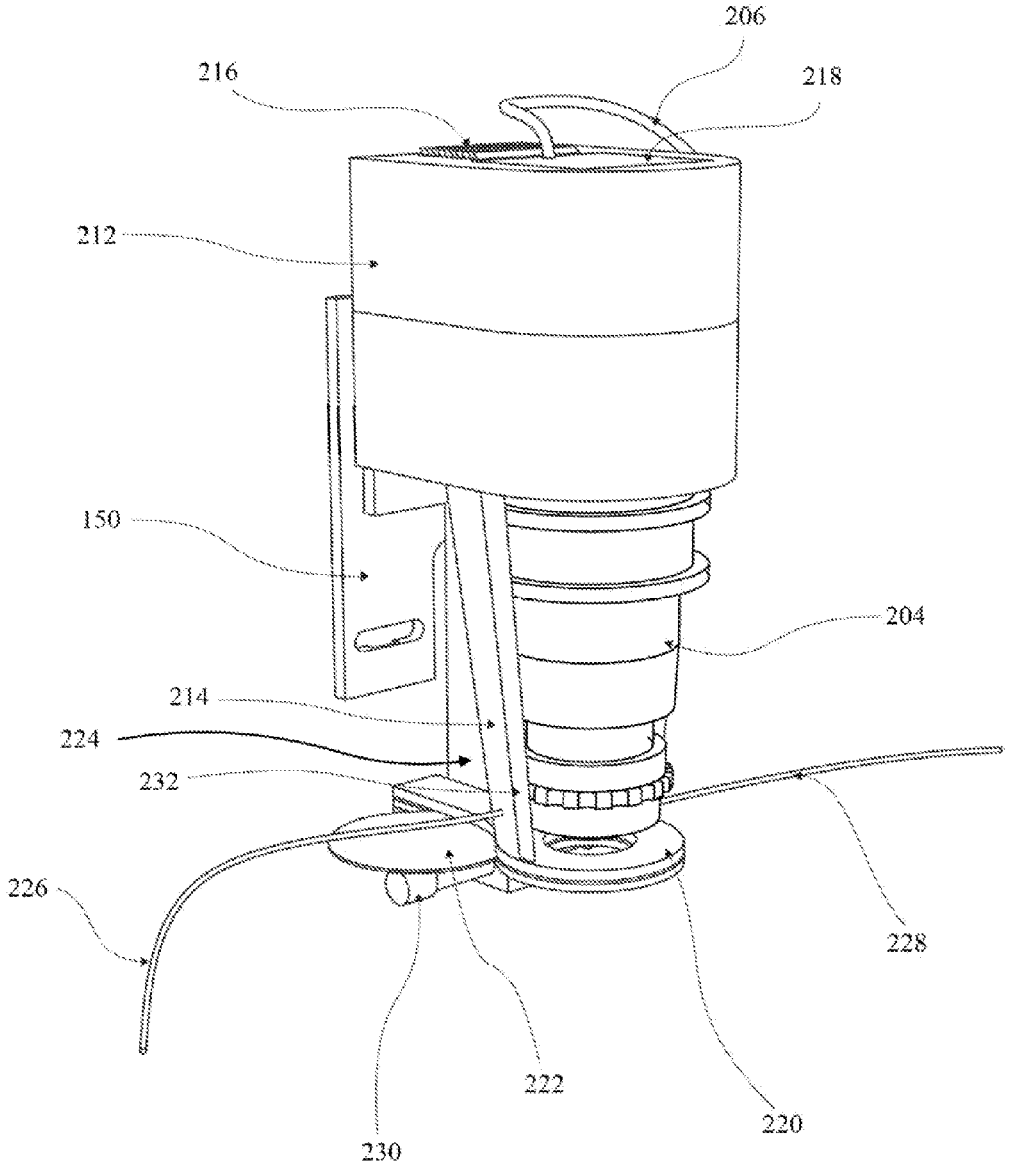
FIG. 2 shows an example of a perspective view of a imaging device and imaging device housing in accordance with some embodiments of the disclosed subject matter.

FIG. 2 shows an example of a perspective view of an imaging device 200 (of which an image sensor 202 is hidden, but is illustrated in, for example, FIG. 1) within an imaging device housing 210 in accordance with some embodiments of the disclosed subject matter. In some embodiments, for example as shown in FIG. 1, imaging device 200 can be mounted to camera mounting assembly 130 without enclosing imaging device 200 in imaging device housing 210.

In some embodiments, imaging device 200 can include any suitable imaging device for performing any suitable imaging. For example, imaging device 200 can include hardware and/or software for performing optical imaging, X-ray fluorescence imaging, X-ray diffraction imaging, cathodluminescence imaging, infrared imaging, gamma radiation imaging, alpha radiation imaging, surface reflectivity imaging, and/or any other suitable imaging.

In some embodiments, imaging device 200 can include an image sensor 202 (as shown in FIG. 1) and an imaging optics assembly 204. Image sensor 202 can be any suitable image sensor, such as a charge-coupled device (CCD)-type image sensor, a complimentary metal-oxide-semiconductor (CMOS)-type image sensor, or any other suitable image sensor, and can include an image sensor housing that encloses the image sensor and any other suitably circuitry used for generating images. Further, image sensor 202 can include any suitable number of pixels and can be in any suitable format (e.g., size, aspect ratio, etc.). For example, image sensor 202 can include one million pixels, two million pixels, ten million pixels, or any other suitable number of pixels. Similarly, image sensor 202 can be any suitable format, such as 7.6 mm by 5.7 mm, NIKON 1/CX (e.g., 13.2 mm by 8.8 mm), APS-C format (e.g., 22.2 mm by 14.8 mm), 35 mm full frame (e.g., 36 mm by 24 mm), Medium Format (e.g., 50.7 mm by 39 mm), a larger format (e.g., over 50.7 mm by 39 mm), or any other suitable format. In some embodiments, different optics and/or different focal lengths can be used to use the full extent of the image sensor.

In some embodiments, imaging optics assembly 204 can include one or more lenses, such as an objective lens and any other lenses for focusing, reducing aberrations, or any other suitable lenses. Imaging optics assembly 204 can further include a focusing mechanism such as a focus ring, a diaphragm, or any other suitable optical elements. In some embodiments, a macro lens can be used such that an image of sample 108 produced on image sensor 202 is reproduced at a ratio of at least one to one with the physical size of sample 108. For example, using a 120 mm macro lens and a Medium Format image sensor, a 60 mm by 45 mm field of view can be captured at a ratio of approximately one to one.

In some embodiments, image sensor 202 and imaging optics assembly 204 can be coupled using any suitable techniques. For example, imaging optics assembly 204 can be coupled to image sensor 202 in a separable manner using a bayonet mount, or the like. As another example, imaging optics assembly 204 and image sensor 202 can an integral device. As yet another example, as described below, image sensor 202 and imaging optics assembly 204 can be coupled to the housing diaphragm.

In some embodiments, a data transmission cable 206 can be coupled to imaging device 200. For example, data transmission cable 206 can be coupled to image sensor 202 to, among other things, transfer images captured by imaging device 200 and/or transmit instructions that cause imaging device 200 to capture images.

In some embodiments, as illustrated in FIG. 2, imaging device housing 210 can include a top housing compartment 212 and a bottom housing compartment 214. Top housing compartment 212 can enclose image sensor 202, and a housing diaphragm (not shown) can separate top housing compartment 212 and bottom housing compartment 214. Top housing compartment 212 can further include a vent 216 that allows heat generated by image sensor 202 to dissipate, and a top access door 218 that can provide access to image sensor 202 without disassembling top housing compartment 212. Additionally, data transmission cable 206 can pass through top housing compartment 212 and be coupled to image sensor 202.

In some embodiments, top housing compartment 212 can be coupled to different bottom housing compartments 214 for different imaging optics assemblies 204. For example one bottom housing assembly 214 can be configured to house a 70 mm focal length lens assembly, and a different bottom housing assembly 214 can be configured to house a 120 mm focal length lens assembly. In some embodiments, bottom housing assembly 214 can include a bellows that can be adjusted to accommodate various optics, which can include macroscopic lens assemblies, microscope lens assemblies, or any other suitable optics.

In some embodiments, a bottom housing seal 220, which can include a bottom housing door 222, can abut bottom housing compartment 214 during operation of the serial sectioning and imaging apparatus (e.g., as described in connection with FIG. 6). Additionally or alternatively, bottom housing seal 220 can be included as part of bottom housing compartment 214.

In some embodiments, as shown in FIG. 1, bottom housing seal 220 can be coupled to mount neck 134 by a seal adjustment armature 224. In such embodiments, bottom housing compartment 214 can be attached to top housing compartment 212 and bottom housing seal 220 by first lowering bottom housing seal 220 by adjusting a position of seal adjustment armature 224 to a position where bottom housing compartment 214 can be inserted between bottom housing seal 220 and top housing compartment 212. Bottom housing compartment 214 can then be mounted on a recessed ring (not shown) on an interior face of bottom housing seal 220, and bottom housing seal 220 mounted with bottom housing component 214 can be moved into a position where bottom housing compartment 214 meets a ring (not shown) on a bottom side of the housing diaphragm. The position of seal adjustment armature 224 can be locked to inhibit movement of bottom housing compartment 214 and bottom housing seal 220 during operation of the serial sectioning and imaging apparatus.

In some embodiments, an air hose 226 can enter bottom housing compartment 214 to create positive pressure during operation of the serial sectioning and imaging apparatus. Creating positive pressure can include, for example, introducing clean and/or dry air to the bottom housing compartment 214 through air hose 226. In some embodiments, positive pressure introduced in bottom housing compartment 214 can inhibit entry of dust, debris and/or other material that may be produced during serial sectioning of sample 108 when bottom housing door 222 is opened.

In some embodiments, a motorized and/or automated turret can include multiple imaging devices so that after each sectioning, a variety of imaging data can be collected. Such different imaging data can be used to determine different information when reconstructing a three-dimensional model of features included in sample 108, as well as performing analyses of composition and/or mineralogy of sample 108.

In some embodiments, a shut-ter relay cable 228 can be coupled to imaging device 200. Shutter relay cable 228 can be used to transmit signals to transmit signals to cause imaging device 200 to capture an image of sample 108.

In some embodiments, one or more proximity switches 230 can be coupled to bottom housing seal 220. Proximity switches 230 can be any suitable proximity switch, such as an optical proximity switch, an infrared proximity switch, a magnetic proximity switch, or any other suitable proximity switch. Proximity switch 230 can be mounted on one or more sides of bottom seal 220, and, in operation, can be used in determining whether bottom housing door 222 is open for imaging. In some embodiments, when proximity switch 230 detects that bottom housing door 222 is open, proximity switch 230 can cause an imaging operation of imaging device 200 to be carried out.

In some embodiments, bottom housing compartment 214 can further include a bottom access door 232 for accessing imaging optics assembly 204 after mounting bottom housing compartment 214 between bottom housing seal 220 and top housing compartment 212. Bottom access door 232 can be sliding door or hinged access door that can be opened to, for example, perform manual focusing of imaging optics assembly 204. In some embodiments, bottom access door 232 can include a bellows that can be raised or lowered to provide access to imaging optics assembly 204.

Figure 3:
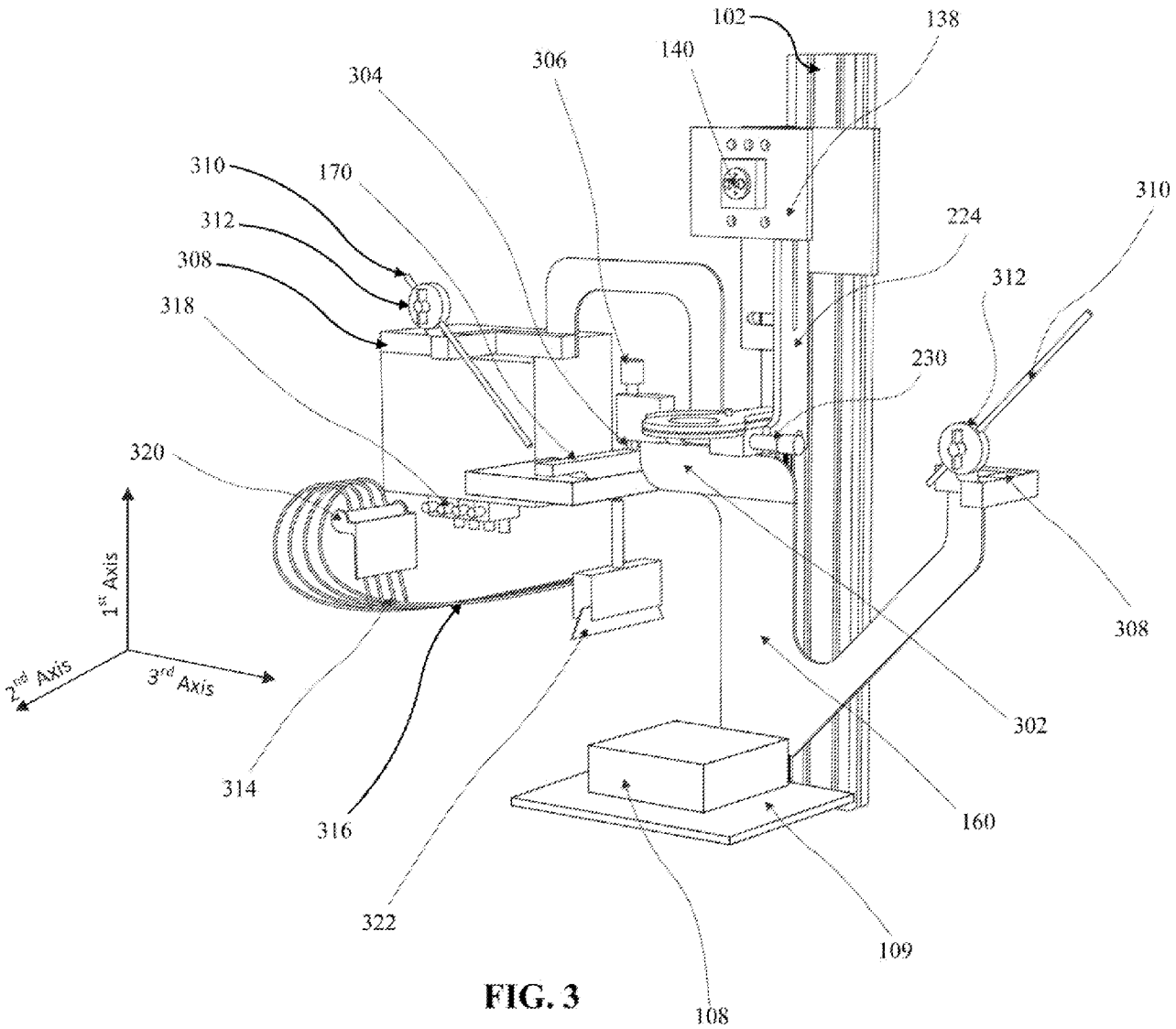
FIG. 3 shows an example of another perspective view of an imaging assembly and a sample preparation assembly in accordance with some embodiments of the disclosed subject matter.

FIG. 3 shows an example of another perspective view of the imaging assembly 100 with the imaging device removed, in accordance with some embodiments of the disclosed subject matter. FIG. 3 further shows an example of a sample preparation assembly of the serial sectioning and imaging device.

As shown in FIG. 3, in some embodiments, a translational bridge portion 302 of translational armature 160 can be used to couple translational armature 160 to track 170 via a translational bearing 304. Translational bearing 304 can include a bearing or carriage, as described above in connection with FIG. 1, to allow movement of track 170 with respect to translational bridge portion 302.

In some embodiments, a fine focus adjustment portion 306 can be disposed between translational bridge portion 302 and translational bearing 304. Fine focus adjustment portion 306 can include a fine adjustment knob, or the like, that when used can adjust the height, in the first axis direction, of translational bridge portion 302 with respect to track 170 in fine increments.

In some embodiments, translational armature 160 can include one or more lighting arms that can be coupled to lighting stages 308. One or more light positioning wands 310 can be coupled to each lighting stage 308 via a light rotation adjustment 312. In some embodiments, these lighting arms can be positioned equidistant from a center of an imaging position located in an imaging axis of imaging device 200, when mounted. As described below in connection with, for example, FIG. 4, a lighting source can be mounted on light positioning wand 310. A direction of the light can be adjusted by loosening light rotation mechanism 312, adjusting a position of light positioning wand 310, and then tightening light rotation mechanism 312 to fix the position of the light mounted to light positioning wand 310. Further, lighting stage 308 can include a slot along which the position of light rotation adjustment 312, light positioning wand 310, and a light mounted to light positioning wand 310 can be adjusted in the second axis and/or third axis directions.

In some embodiments, after a position of light positioning wand 310 is fixed with respect to top surface 110 of sample 108, a light mounted to lighting wand 310 can move in the first axis direction along with camera assembly 100 and the serial sectioning apparatus. This allows for the spatial relationship of the lights to the top surface 110 of sample 108 to be maintained and thus the lighting conditions for each imaging operation to be substantially the same. Additionally or alternatively, a ring light can be provided where a center of the ring light can substantially coincide with an imaging axis of an imaging device being used.

In some embodiments, a sample preparation assembly can be coupled to the serial sectioning and imaging assembly. The sample preparation assembly can include a number of sprayer nozzles 314 that can each be used for spraying compressed air, mist, or any other suitable substance (e.g., gas, liquid, abrasive material, etc.). Each spray nozzle 314 can be coupled to a source via lines 316. Lines 316 can be coupled between nozzles 314 and cylinder valves 318 which can be adjusted to regulate the amount of air, fluid or other suitable substance that is delivered and/or how the substance is delivered (e.g., as a drip, a mist, a jet, a stream, etc.). Any suitable substance can be used by the sample preparation assembly. For example, in some embodiments, one or more spray nozzles 314 can be used to spray compressed air on top surface 110, to clean top surface 110. As another example, one or more spray nozzles 314 can be used to spray water soluble oil on top surface 110 to prepare sample 108 for imaging. As yet another example, for materials that are water soluble, non-water soluble oil or any other suitable non-water soluble liquid can be used to prepare sample 108 for imaging.

In some embodiments, each spray nozzle 314 can be independently controlled to deliver material to top surface 110. Additionally, in some embodiments, each spray nozzle can be coupled to a nozzle adjustment portion 320 that can be used to change an orientation of spray nozzles 314 individually, or together. For example, spray nozzles 314 can be aimed in any suitable direction, which can be based on a size of sample 108. More particularly, spray nozzles 314 can be aimed farther apart, closer together, closer to or farther away from the top surface 110 of sample 108, etc. As another example, sample 108 can be moved relative to spray nozzles 314 to provide a more even distribution of the substance deposited by spray nozzle 314 (e.g., liquid, gas, etc.).

In some embodiments, a pneumatic wiper 322 can be coupled to the serial sectioning apparatus. Pneumatic wiper 322 can be actuated to evenly distribute and/or remove excess fluid, debris, or other substance, such as water soluble oil or specimen particulates, from top surface 110 of sample 108 prior to performing an imaging operation.

In some embodiments, the sample preparation assembly can include a collection component (not shown) that can collect excess coolant, debris that is generated during material removal, or the like. For example, in some embodiments, the collection component can include a system for collecting mist and/or spray generated from coolant used during the material removal. As another example, the collection component can include a system for collecting dust and/or debris generated from the sample (e.g., in cases where coolant is not used).

Figure 4:
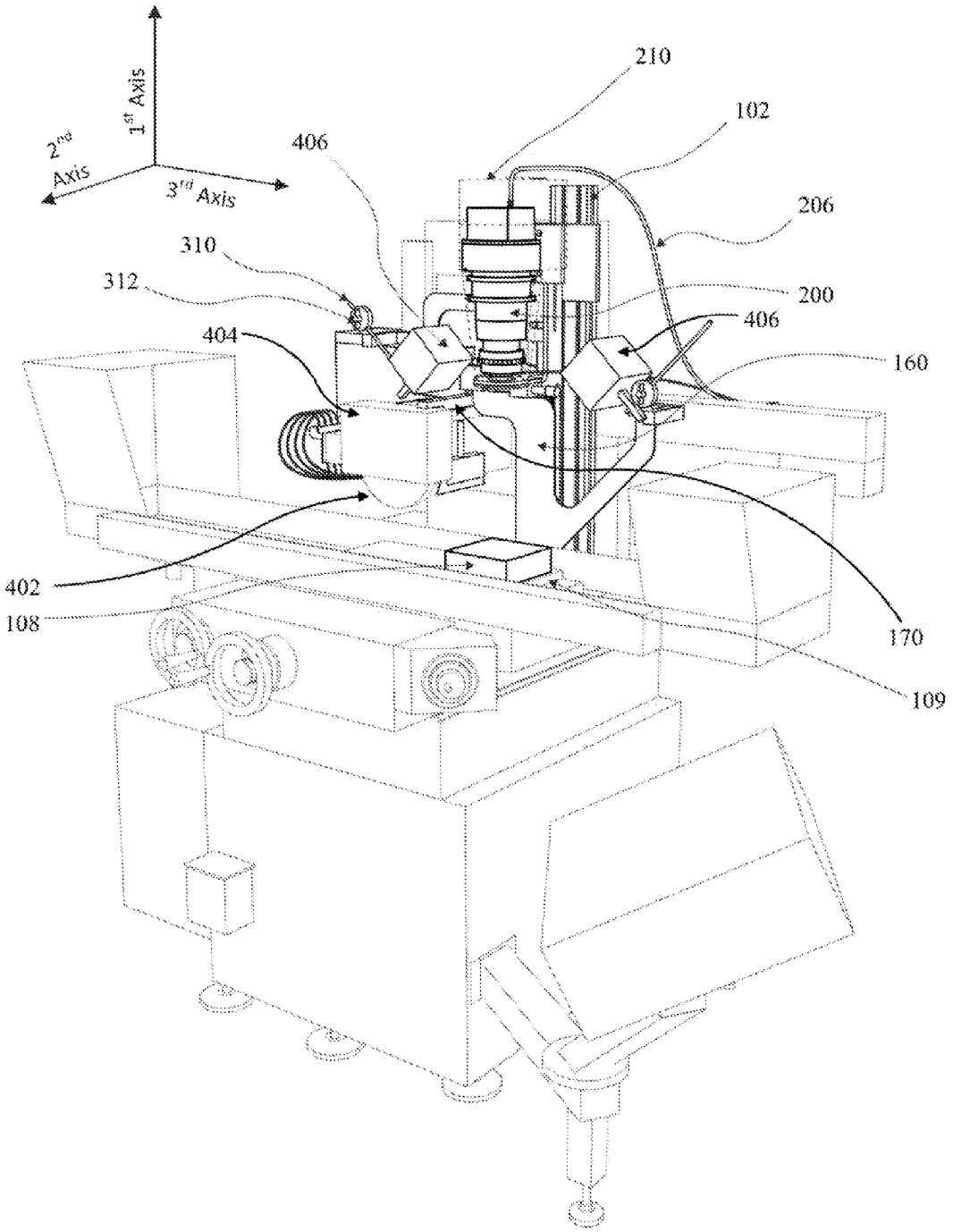
FIG. 4 shows an example of a perspective view of an imaging assembly and a sample preparation assembly coupled to a serial sectioning apparatus in accordance with some embodiments of the disclosed subject matter.

FIG. 4 shows an example of a perspective view of the serial sectioning and imaging apparatus in accordance with some embodiments of the disclosed subject matter. As shown in FIG. 4, imaging assembly 100 can be coupled to a serial sectioning apparatus 400 by rail 102.

In some embodiments, serial sectioning apparatus 400 can include any suitable components for performing serial sectioning. For example, in some embodiments, serial sectioning apparatus 400 can include a computer numerical control (CNC) material removal tool. In a more particular example, serial sectioning apparatus can include a CNC material removal tool for controlling operation of a surface grinder. In some embodiments, CNC material removal tool can control positions of certain components to a high degree of accuracy can be used. For example, a three-axis CNC material removal tool that can be controlled to within a tolerance of 2.5 microns or less can be used. In a more particular example, a position of a bed of the (CNC machine for moving a sample can be controlled in, for example, a second axis direction to within 2.5 microns of a desired position along the second axis, and a third axis direction to within 2.5 microns of a desired position along the third axis. Similarly, a position of a grinding wheel, or the like along the first axis can be controlled to within 2.5 microns of a desired position in the first axis.

Additionally, a closed loop positioning system can be used to measure the actual position of the material removal tool and/or the movable bed of serial sectioning apparatus 400 along each axis (e.g., along the first axis, second axis, and third axis) to a much, higher degree of precision. For example, some currently available closed loop positioning systems using glass scales that encode a position along each axis can be used to determine a position along each axis to 0.1 microns. The position determined by the closed, loop system can be used to control the CNC material removal tool to a greater degree of accuracy, and/or can be noted and used when reconstructing images and/or models based on images captured using imaging assembly 100.

The description herein of the precision and accuracy of the CNC material removal tool and/or the closed loop positioning system is merely illustrative and the mechanisms described herein can be used with tools of varying degrees of accuracy.

In some embodiments, serial sectioning apparatus 400 can include a material removal tool 402 located within a wheel housing 404. Material removal tool 402 can include any suitable material removal tool suitable for performing serial sectioning. For example, as shown in FIG. 4, material removal tool can include a grinding wheel, such as a diamond tipped grinding wheel. As another example, a polishing film attached to a polishing plate can be used for performing serial sectioning. As another example, a machining tool can be used to for performing serial sectioning. As yet another example, an energy based technique(s), such as laser cutting techniques, can be used for performing serial sectioning. These examples are merely illustrative, and it is understood that any suitable removal tool can be used with the mechanisms described herein. In a more particular example, serial sectioning apparatus 400 can include an 818 Linear Surface Grinder available from Matsui High-Tec of Kitakyushi, Japan.

In some embodiments, sample mounting plate 109 and sample 108 can be mounted to serial sectioning apparatus 400 using any suitable technique(s). For example, sample mounting plate 109 can be composed of a magnetic metal plate which can be secured to sectioning apparatus 400 by a magnetic chuck (not shown). As another example, sample mounting plate 109 can be securely mounted to sectioning apparatus 400 using a vacuum chuck. Such a chuck for mounting a sample can be affixed to a movable bed of sectioning apparatus 400. As yet another example, sample mounting plate 109 can be omitted, and sample 108 can be secured to a bed, or the like, of the serial sectioning apparatus 400 using a vice and/or other hardware, an adhesive, etc.

In some embodiments, one or more lights 406 can be coupled to lighting stage 308, as described above in connection with FIG. 3. Lights 406 can include any suitable light, at any suitable wavelength(s). In some embodiments, lights 406 can include multiple light sources that can be controlled individually, based on a type of imaging being performed. Furthermore, in some embodiments, multiple images can be captured, each using a different light source from lights 406. As described above in connection with FIG. 3, a direction of light 406 can be adjusted based on a size of sample 108.

In some embodiments, multiple imaging assemblies 100 can be coupled to serial sectioning apparatus 400. For example, a first imaging assembly can be coupled to serial sectioning apparatus 400 for capturing images of the entirety of top surface 110 of sample 108 using a Medium Format camera, or the like. A second imaging assembly can be coupled to serial sectioning apparatus 400 (e.g., on an opposite side of wheel housing 404 from imaging assembly 100 shown in FIG. 4, to the right of imaging assembly 100 shown in FIG. 4, or at any other suitable location) for capturing images of a particular region(s) of top surface 100 at greater magnification (e.g., using a microscope). In such an example, a location of the second imaging device in the first axis direction can be maintained by coupling a translational armature of the second imaging assembly to the translational armature of the first imaging assembly. Any suitable number of imaging assemblies can be coupled to serial sectioning apparatus in this manner, with the only limitation being the size of the serial sectioning apparatus. This can facilitate the automatic capture of images of the entire face, as well as magnified images of a region of interest, or the like.

In some embodiments, serial sectioning apparatus 400 can be controlled using a set of Numerical Control (NC) instructions. These instructions can be in any suitable form, such as G-Code and M-Code. As used herein, G Code refers to a programming language that can be used to move a mounting surface to which a sample can be mounted (e.g., a bed) and a material removal tool (e.g., a grinding wheel) to various positions (e.g., along the first axis, second axis, and/or third axis) for performing operations of serial sectioning apparatus 400. Additionally, such a G-Code instruction set can also be used to control additional parameters, such as speed and/or pause duration of movements. In some embodiments, a user can be aided in creating the G-Code instruction set through a macro program accessible by a user interface (not shown) of serial sectioning apparatus 400 such as a graphical user interface, through a user interface of a computer, or the like, that is operatively coupled to serial sectioning apparatus 400 and/or through files prepared in computer-aided manufacturing (CAM) software on any suitable device and loaded using a hardware processor of serial sectioning apparatus 400.

In some embodiments, other operations of the serial sectioning and imaging apparatus described herein can be controlled using M-Code. Such M-code can be used to control dual-state operations (e.g., on/off, up/down, etc.) such as compressed air delivery using nozzles 314, misting using nozzles 314, movement of wiper 322, open/closing of bottom housing door 222, shutter release, etc. Serial sectioning apparatus 400 can include one or more general purpose input/output (IO) modules that can be used to provide current for driving a relay. For example, a relay output board connection can have available connections where a relay can be connected for electrical isolation to a shutter of imaging device 200, to bottom housing door 222, to nozzles 314, to wiper 322, etc.

In some embodiments, an M-Code command for triggering a dual-state operation of a component can be sent, which can cause the relay output board to latch a particular relay corresponding to the component. This can, in turn, trigger a particular action of the component, which can be caused by the relay itself or by activation of a solenoid which can in turn cause the component to perform a particular action (e.g., spray mist, blow compressed air, lower the wiper, open the bottom housing door, capture an image, etc). After a short delay (which can be set at any suitable interval) to wait for the action to be performed, the relay output board can cause the relay to unlatch, and/or a second M-Code command can be sent to stop the action, or a command can be sent to retract a solenoid.

Figure 5:
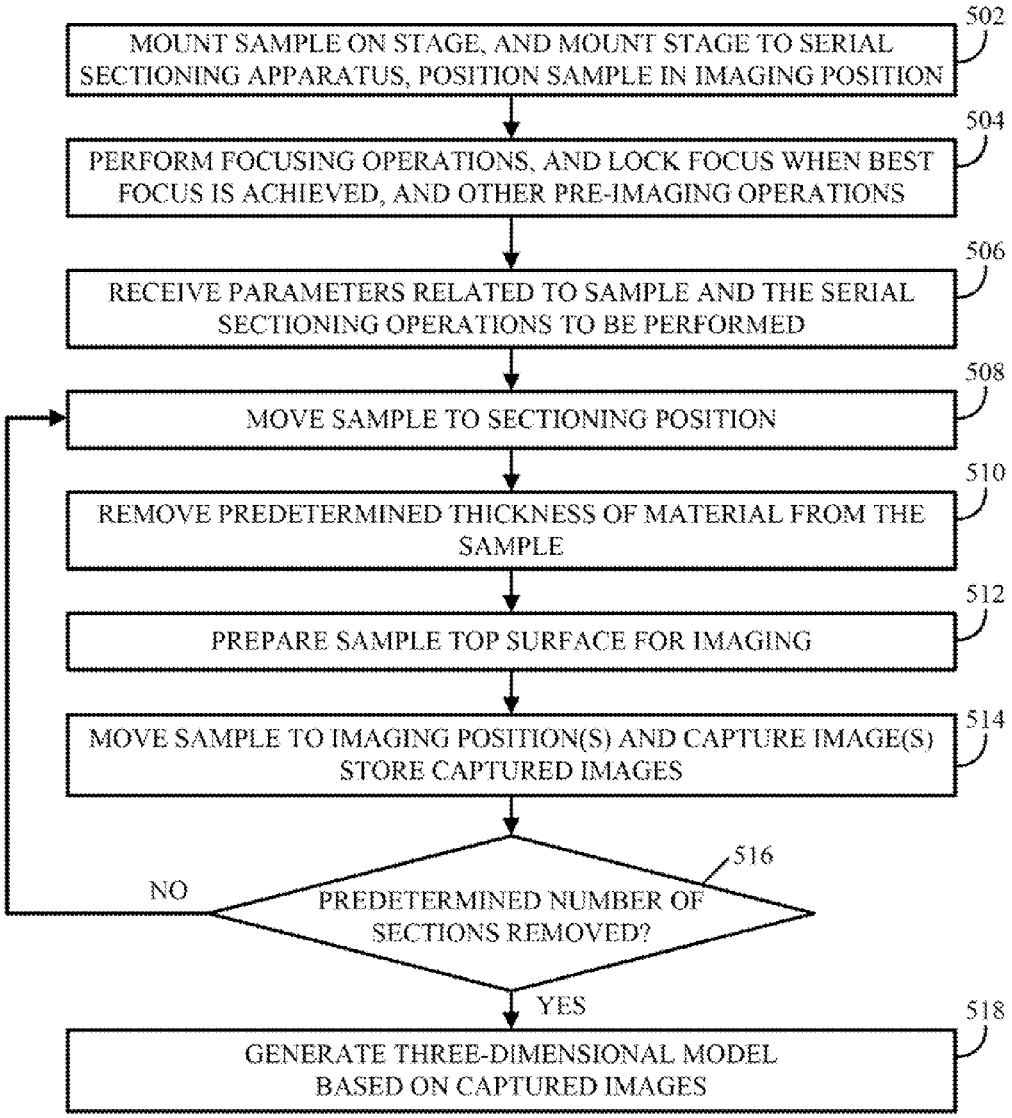
FIG. 5 shows an example of a process for serial sectioning and imaging in accordance with some embodiments of the disclosed subject matter.

FIG. 5 shows an example of a process 500 for serial sectioning and imaging a sample in accordance with some embodiments of the disclosed subject matter. In some embodiments, portions of process 500 can be implemented using a hardware processor to provide numerical controls to a CNC material removal tool. Such numerical control can be based on G-code commands and/or M-code commands, as described above in connection with FIG. 4, that can be sent by a hardware processor to control operation of serial sectioning apparatus 400.

As illustrated, at 502, sample 108 can be mounted to sample mounting plate 109, and sample mounting plate 109 can in turn be mounted to serial sectioning apparatus 400, by for example, mounting sample mounting plate 109 to a magnetic chuck. In some embodiments, sample 108 can include any material, and can be mounted to sample mounting plate 109 using any suitable techniques. For example, in some embodiments, sample 108 can be mounted to sample mounting plate 109 using adhesive, such as hot glue, epoxy, etc. As another example, sample 108 can be mounted to sample mounting plate 109 using hardware, such as clamps, bolts, etc. In some embodiments, prior to mounting sample 108, sample 108 can be prepared by, for example, performing a rough cut of a bottom mounting surface and a top surface of the sample using, for example, a wet saw (e.g., an oil saw, a tile saw, etc.). After mounting, and prior to performing a focusing operation, a top surface of the sample can be prepared using grinding wheel 402 (or any other suitable removal tool) to make the surface suitable for focusing.

Further, at 502, sample mounting plate 109 can be positioned in an imaging position, where images are to be captured by an imaging device 200, such as a camera. In some embodiments, a single imaging position can be established, wherein a center of sample mounting plate 109 and/or sample 108 can be positioned substantially in a center of an imaging axis of imaging device 200. Additionally or alternatively, multiple imaging positions can be established and images captured at each position can be combined (e.g., as a mosaic) to create a single image. In a particular example, in FIG. 4, sample 108 is shown as being positioned in the imaging axis of imaging device 200. This is sometimes referred to herein as a parked position.

Referring back to FIG. 5, at 504, a focusing operation of an imaging device, such as imaging device 200, can be performed to achieve a suitable degree of focus on top surface 100 of sample 108. In some embodiments, a position of imaging device 200 can be adjusted along guide 150 and when imaging device 200 is at an appropriate level, positioning pin 152 can be used to fix the position of imaging device with respect to top surface 110 of sample 108. Additionally, alignment between an imaging axis (e.g., an optical axis where the imaging device includes optics) of imaging device 200 and top surface 110 of sample 108 can be checked to determine whether the alignment is proper (e.g., that the imaging axis is perpendicular to top surface 110, that a focal plane of a lens of imaging device 200 is parallel to top surface 110, etc.). If the alignment is incorrect, a pitch-yaw orientation of the imaging device can be adjusted (e.g., by adjusting a connection between rear mount plate 136 and front mount plate 138, or using any other suitable technique(s)) as necessary to ensure that proper alignment is achieved.

In some embodiments, after imaging device 200 is fixed at a suitable position, with bottom housing door 222 open, imaging device 200 can be manually focused. For example, a user can open bottom access door 232 and can adjust a focus of imaging optics assembly 204 using a focus ring, or the like. During a focusing operation, images of top surface 110 captured by image sensor 202 can be displayed to a user on a display coupled to image sensor 202 (e.g., by data transmission cable 206) such that a user can judge a degree of focus. When a rough focus has been achieved (e.g., a best focus possible using a focus ring, or the like), a focus position of imaging optics 200 can be fixed, and a user can perform a fine focusing operation using fine adjustment portion 306 to control a first axis distance between imaging device 200 and top surface 110. This can be performed until a suitably high degree of focus is achieved.

Additionally, a degree of focus can determined by a hardware processor based on images captured by image sensor 202. For example, any suitable technique(s) for determining a degree of focus can be determined (e.g., based on contrast gradients, sharpness gradients, an absolute degree of sharpness or contrast, using phase detection techniques, hill climbing techniques, range finding techniques, etc.), and information on a degree of focus can be presented to a user that is performing a manual focusing operation.

Alternatively, a focusing operation can be automated based, on a determined degree of focus. For example, a position of imaging device 200 with respect to surface 110 can be automatically adjusted between fixed positions along guide 150 (e.g., using a motor) based on an outputted degree of focus (e.g., by receiving a degree of focus determined by imaging device 200, or by determining a degree of focus based on images captured by imaging device 200). When a position is found with a highest degree of focus, the position of imaging device 200 with respect to top surface 110 can be fixed (e.g., by causing positioning pin 152 to move into a set hole corresponding to the position). Then a rough focusing operation can be performed by controlling a focal length of imaging optics assembly 204 until a highest degree of focus is achieved. Finally, fine adjustment portion 306 can be controlled (e.g., using a motor), until a highest degree of focus is achieved. As another example, a motor driven fine focusing operation can be controlled based on laser-based distance measurements.

In some embodiments, after a focusing operation is complete, bottom access door 232 (or bellows, etc.) and bottom housing door 222 can be closed to protect imaging device 200 during operation of serial section apparatus 400.

In some embodiments, a position of lights 406 can be set at 504 in concert with performing focusing. Maintaining the same lighting conditions and the same working distance while the specimen decreases in size with successive grinds (at 508 through 516) can allow images to be captured for each layer with substantially identical optical qualities, which can enhance the ability to perform an accurate three-dimensional reconstruction.

At 506, process 500 can receive parameters related to the sample and/or parameters related to a serial sectioning process to be performed on the sample. For example, parameters such as size of the sample, thickness of sections to remove, size of a grinding wheel, imaging position(s) if a position other than a center position is to be used, a rotational speed of the spindle (e.g., in revolutions per minute), a rate at which to move the sample under the material removal tool, etc. As described above, these parameters can be entered using any suitable technique(s), such as by entering the parameters into a CNC macro program, using a user interface (e.g., a graphical user interface). As another example, a size of the sample, material(s) of the sample and parameters of a grinding wheel being used (e.g., size, hardness, etc.) can be entered, and other parameters can be automatically calculated based on these parameters.

At 508, process 500 can cause sample 108 to be moved to a sectioning position along the first axis and/or second axis. For example, sample 108 can be moved from the position shown in FIG. 4, to a position under grinding wheel 402. As described above, positioning of sample 108 can be controlled using any suitable Numerical Control (NC) techniques, such as G-Code commands.

At 510, process 500 can cause a predetermined thickness of material to be removed from the sample. Any suitable thickness of material can be removed, down to a minimum thickness that can be removed due to limitations of the serial sectioning apparatus being used to perform material removal. For example, if a grinding wheel is used, as shown in FIG. 4, a predetermined thickness can be removed based on a position of a spindle of the serial sectioning apparatus (which can be determine using the closed loop system, as described above) along the first axis and a radius of the grinding wheel. Using this information, the serial sectioning apparatus can be controlled (e.g., using G-Code), to remove a predetermined thickness (e.g., a thickness of a section entered by a user). In a more particular example, sections of 2.5 microns, 5 microns, 10 microns, 50 microns, etc., can be removed. These example thicknesses are merely illustrative and a thickness of a section to be removed can be determined based on various factors, such as limitations of the machinery being used (e.g., a minimum thickness that can be removed), an amount of detail required (e.g., a size of objects in the sample), etc.

As described above, because the imaging device 200 is mounted to translational armature 160, as grinding wheel 402 is moved in the first axis direction, imaging device 200 moves in the same direction and the same magnitude. This maintains the spatial relationship between top surface 110 and imaging device 200 such that imaging device 200 does not require refocusing between sections.

In some embodiments, process 500 can cause material removal at 510 to be performed using a removal technique(s) using a coolant to reduce heat, or the like, generated in the removal tool and/or sample during removal operations. Additionally or alternatively, process 500 can cause material removal at 510 to be performed without coolant. In such cases, a speed of the removal tool may be reduced, a different tool may be used, etc. Material removal without coolant may be performed, for example, in cases where the sample includes water soluble materials, or for any other suitable reason.

At 512, process 500 can prepare a newly exposed top surface 110 of the sample for imaging. In some embodiments, this can include causing dust, debris, other material, and/or coolant used during the material removal process at 510 to be removed from top surface 110 using compressed air blown on top surface 110 out of at least one spray nozzle 314. Additionally or alternatively, preparing the sample for imaging can involve misting the surface with a water soluble oil from at least one spray nozzle 314, which can enhance contrast for imaging with an optical imager, such as a CCD imager or a CMOS imager. Further, misting combined with wiping by pneumatic wiper 322 can serve to clean a surface of some particulates or other material that may not have been removed by the compressed air.

In some embodiments, preparing the surface for imaging can further include process 500 causing pneumatic wiper 322 to be positioned in a path of top surface 110 of sample 108 as sample 108 is moved into an imaging position. As sample 108 is moved under pneumatic wiper 322, a distribution of the water soluble oil sprayed on top surface 110 can be smoothed and/or excess water soluble oil can be removed. In some embodiments, after sample 108 has been moved to the imaging position (at 514), process 500 can cause pneumatic wiper 322 to be raised to a position where it does not contact top surface 110 when moving sample 108 back to the sectioning position at 508.

At 514, process 500 can cause sample 108 to be moved into an imaging position and, when process 500 determines that sample 108 is in position, can cause an image to be captured using imaging device 200. In some embodiments, a parked position of the sample can be recorded when focusing is performed at 504 (e.g., based on a position determined using the closed loop system), and process 500 can determine that the sample is in an imaging position when a position of the sample determined using the closed loop system is the same as the parked position within a predetermined tolerance, such as 0.1 microns, 0.5 microns, etc., which can depend on a level of detail requested by a user.

In some embodiments, in cases where bottom housing door 222 is used, process 500 can cause bottom housing door 222 to be opened when it is determined that sample 108 is in the imaging position. In some embodiments, after causing bottom housing door 222 to be opened, process 500 can determine if a signal has been received from proximity switch 230 indicating that bottom housing door 222 has opened. Alternatively, in some embodiments, when proximity switch 230 detects that bottom housing door 222 has opened, proximity switch can transmit a signal that causes imaging device 200 to capture an image.

In some embodiments, an image captured at 514 can be stored in a local storage device (e.g., a hard drive, a flash drive, a tape drive, etc.) and/or can be transmitted for storage remotely (e.g., on a remote server, to a remote computer for three-dimensional reconstruction, etc.). As described above, multiple images can be captured for each sectioning if a large sample is being sectioned, and multiple images are captured for processing using mosaic imaging techniques, or if images are captured using different types of imaging devices.

At 516, process 500 can determine whether a predetermined thickness has been removed and/or whether a predetermined number of sections have been removed. For example, given the dimensions of the sample, a number of sections to image, and/or a thickness of material to be removed as input by a user at 506, process 500 can determine whether the predetermined number of sections have been removed. In some embodiments, process 500 can perform a user verification after removing a predetermined number of sections. For example, a predetermined number of sections (e.g., one section, five sections, ten sections, etc.) can be imaged and process 500 can pause at 516 after determining that the predetermined number of sections have been removed, and a user and/or a computing device (such as a personal computer, etc.) can be prompted to verify whether the sectioning should continue, or whether to change parameters before continuing and/or whether to notify a user to change parameters before continuing (e.g., if the computing device determines that the captured images are of a low quality). For example, after five sections have been removed and images have been captured, such a computing device can verify that five image files have been captured in an image storage location (e.g., computer memory and/or storage), that these five images have similar image qualities (e.g., histograms, contrast, etc.), that a measure of focus of the each of images is similar, or any other suitable verification parameters which can be set by a user at 504 in some embodiments. If process 500 receives a verification from the computing device (and/or a user) that the parameters received at 506 are correct, process 500 can proceed to perform 508 through 514 until the predetermined number of sections have been imaged. Further, after focusing and/or after verification, one or more regions of interest can be selected within the sample. Image data from within the region of interest can be extracted and stored for use in reconstructing features within the region of interest (which can be faster and/or less computationally intensive due to the smaller size of the images from the region of interest). In some embodiments, image data from the region of interest can be used for computer-based verification after each image is capture (e.g., as a representative sample of the image data). Additionally, in some embodiments, a manual user verification can be performed after each predetermined number of sections are removed to ensure that sectioning is proceeding normally.

In embodiments where a verification is performed, regions of interest (ROIs) can be established during verification, image processing can be chosen or reconfigured based on verification, etc. Verification images can also be used as a base image from which histograms and verification thresholds can be calculated and used for the entire run (such as sharpness/focus threshold level, brightness level, lamp color temperature, etc.). In some embodiments, after each image is captured, an image verification step can be performed to determine whether to generate an alert. For example, the captured image can be automatically verified before proceeding to remove further sections and capture further images. Such image verification can include comparing properties of a current image such as color and/or contrast (e.g., via histogram correlation), focus metric (e.g., by taking a fourier transform of a predetermined region, such as a ROI), a file size, etc., to the same properties to previously captured images, such as a verification image(s), a random set of previous captured images, or any other suitable images. Process 500 can determine a similarity of these properties based on the comparison (e.g., by generating a similarity score). If a similarity score is below a threshold, sectioning can be paused and a user can be alerted that an abnormal condition has been detected using any suitable technique(s), such as by emailing or sending a text message to a user.

If process 500 determines that the predetermined number of sections have not been removed ("NO" at 516), process 500 can return to 508, and proceed to remove another section and image newly revealed top surface 110. Otherwise, if process 500 determines that the predetermined number of sections have been removed ("YES" at 516), process 500 can proceed to 518.

At 518, one or more three-dimensional models can be created based on the captured images. For example, the captured images can be combined into a three dimensional model of the sample based on the image(s) captured after each predetermined thickness was removed at 510. As another example, a particular three-dimensional feature within the sample can be reconstructed from the sample by removing parts of the image that do not correspond to the feature. In some embodiments, information on the position of the sample at the time of image capture can be used when creating a three dimensional model, which may improve accuracy of the reconstruction.

These mechanisms can be used in a variety of applications, such as three-dimensional reconstruction and analysis of objects embedded in rocks and/or features of rocks. For example, these mechanisms can be used to capture images that be used to create three-dimensional models of fossils (e.g., from early animals (from 0 to 650 million years ago), early sufficiently sized protists (from 0 to 850 million years ago), algae (from 0 to 1800 million years ago), etc.) that are preserved as calcite or calcified skeletons in calcite (e.g., limestone) host rock (e.g., matrix), which often cannot be physically separated from the calcite matrix by preferential dissolution or physical disaggregation. As a more particular example, a full three-dimensional (3D) model of the earliest (e.g., about 650 million years old), very unfamiliar, animals is useful in attempting to understand their functional morphology and/or to determine where they fit in the evolutionary tree.

As another example, these mechanisms can be used to capture images that can be used to construct three-dimensional models of chondrules embedded in chondritic meteorites, amygdules in vesicular basalt, and precipitate-filled cracks in strained rocks. In more particular example, a three-dimensional model created using images captured by serially sectioning a chondritic mediorite can be used to determine the size distribution of chondrules.

Figure 6:
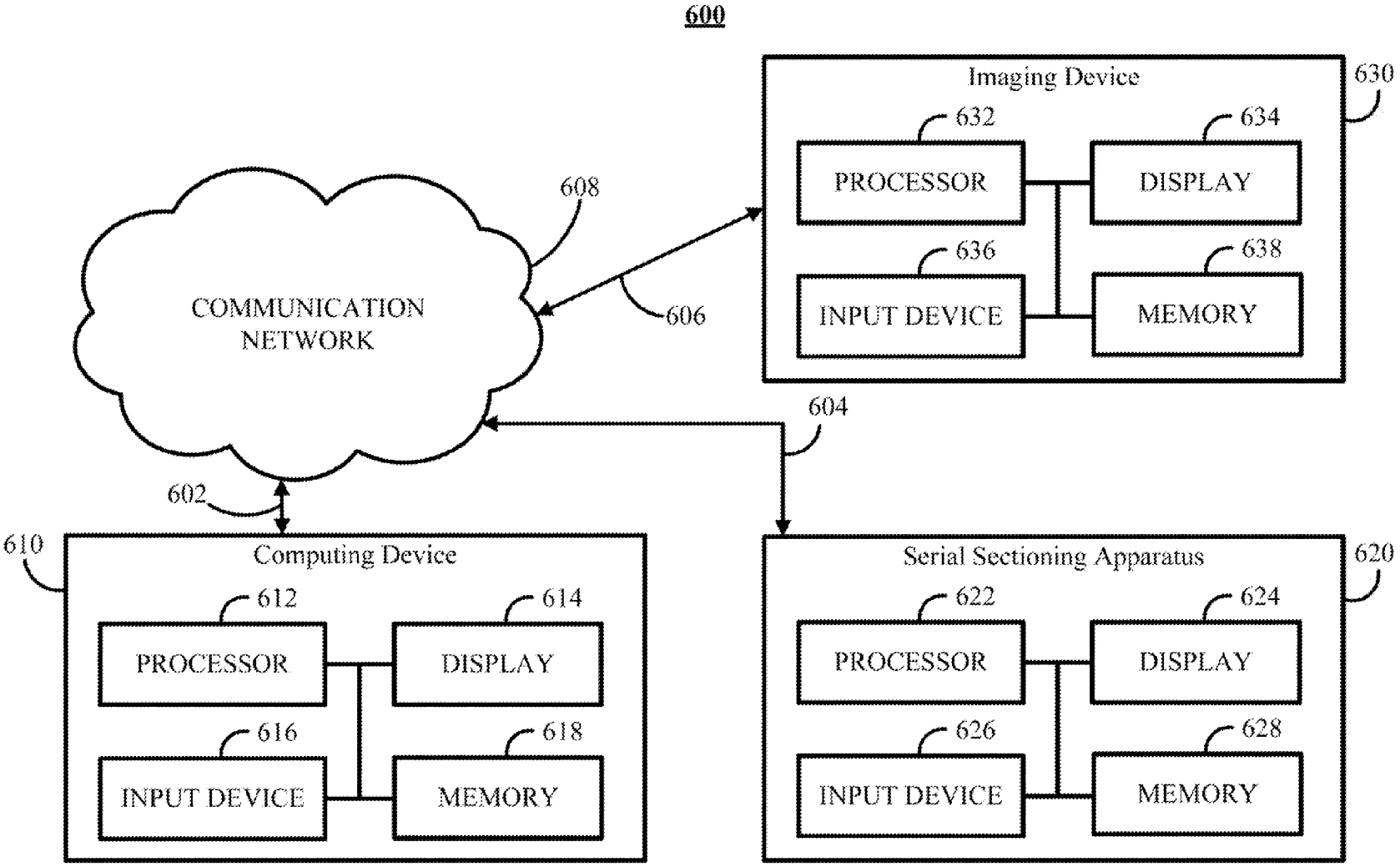
FIG. 6 shows an example of a schematic diagram of a system for serial sectioning and imaging in accordance with some embodiments of the disclosed subject matter.

FIG. 6 shows an example 600 of a schematic diagram of a system on which the mechanisms for serial sectioning and imaging as described herein can be implemented in accordance with some embodiments. As illustrated, system 600 can include one or more computing devices 610. Computing devices 610 can be local to each other or remote from each other. Computing devices 610 can be connected by one or more communications links 602 to a communications network 608 that can be linked via a communications link 604 to serial sectioning apparatus 620 and/or imaging devices 630. System 600 can further include one or more imaging devices 630. Imaging devices 630 can be local to each other or remote from each other. Imaging devices 630 can be connected by one or more communications links 606 to communications network 608 that can be linked via communications link 608 to serial sectioning apparatus 620.

System 600 can include one or more serial sectioning apparatuses 620. Serial sectioning apparatuses 620 can be any suitable any suitable serial sectioning apparatus for performing serial sectioning mechanisms described herein such as serial sectioning apparatus 400 described in connection with FIG. 4.

In some embodiments, each of the computing device 610, serial sectioning apparatus 620, and imaging apparatus 630 can be any of a general purpose device such as a computer or a special purpose device such as a client, a server, etc. Any of these general or special purpose devices can include any suitable components such as a hardware processor (which can be a microprocessor, digital signal processor, a controller, etc.), memory, communication interfaces, display controllers, input devices, etc. For example, computing device 610 can be implemented as a personal computer, a laptop computer, a smartphone, a tablet computer, a gaming device, a server, etc. As another example, image capture device 630 can be implemented as a digital camera (e.g., a point and shoot camera, a DSLR camera, a digital camcorder, etc.), a digital microscope, X-ray fluorescence imager, X-ray diffraction imager, infrared imager, gamma radiation imager, alpha radiation imager, and/or any other suitable imager.

Communications network 608 can be any suitable computer network or combination of such networks including the Internet, an intranet, a wide-area network (WAN), a local-area network (LAN) a wireless network, a digital subscriber line (DSL) network, a frame relay network, an asynchronous transfer mode (ATM) network, a virtual private network (VPN), etc. Communications links 602, 604 and 606 can be any communications links suitable for communicating data among computing device 610, serial sectioning apparatus 620, and imaging device 630, such as network links, dial-up links, wireless links, hard-wired links, any other suitable communications links, or any suitable combination of such links. Computing device 610 can control operation of serial sectioning apparatus 620, for example by transmitting commands, such as G-code commands and M-code commands, as well as receive and/or verify images captured by imaging device 630 to verify operation of serial sectioning apparatus 620, transmit images to a remote computing device, etc. Serial sectioning apparatus 620 can receive commands from computing device 610, perform material removal operations, and any other suitable functions. Imaging device 630 can capture images of top surface 110 of sample 108 and transmit. Computing device 610, serial sectioning apparatus 620, and imaging device 630 can be located at any suitable location.

Computing device 610 can include a hardware processor 612, a display 614, an input device 616, and memory 618, which can be interconnected. In some embodiments, memory 618 can include a storage device (such as a non-transitory computer-readable medium) for storing a computer program for controlling hardware processor 612.

Hardware processor 612 can use the computer program to present on display 614 content and/or an interface that allows a user to, among other things, control serial sectioning apparatus 620 and/or imaging device 630, review images captured by imaging device 630, etc. For example, computing device 610 can be used to control serial sectioning apparatus 620 and/or imaging device 630 for performing at least a portion of process 500. In some embodiments, hardware processor 612 can send and receive data through communications link 602 or any other communication links using, for example, a transmitter, receiver, transmitter/receiver, transceiver, or any other suitable communication device. Input device 616 can a computer keyboard, a computer mouse, a microphone, a touchpad, a voice recognition circuit, a touchscreen, and/or any other suitable input device.

Serial sectioning apparatus 620 can include a hardware processor 622, a display 624, an input device 626, and memory 628, which can be interconnected. In some embodiments, memory 628 can include a storage device for storing data received through communications link 504 or through other links. The storage device can further include a computer numerical control (CNC) program for controlling hardware processor 622.

Hardware processor 622 can use the CNC program to control operation of serial sectioning apparatus 620. Input device 626 can be a computer keyboard, a computer mouse, a touchpad, a voice recognition circuit, a touchscreen, and/or any other suitable input device.

Imaging device 630 can include a hardware processor 632, a display 634, an input device 636, and memory 638, which can be interconnected. In some embodiments, memory 638 can include a storage device (such as a non-transitory computer-readable medium) for storing an imaging program for controlling hardware processor 622.

Hardware processor 622 can use the imaging program to control operation of imaging device 630, receive inputs, and/or transmit captured images to, for example, computing device 610 or any other suitable computing device. In some embodiments, hardware processor 622 can send and receive data through communications link 606 or any other communication links using, for example, a transmitter, receiver, transmitter/receiver, transceiver, or any other suitable communication device. Input device 636 can be a lens, an image sensor, a direction pad, a select button, a computer keyboard, a computer mouse, a microphone, a touchpad, a voice recognition circuit, a touchscreen, and/or any other suitable input device.

In some embodiments, any suitable computer readable media can be used for storing instructions for performing the functions and/or processes described herein. For example, in some embodiments, computer readable media can be transitory or non-transitory. For example, non-transitory computer readable media can include media such as magnetic media (such as hard disks, floppy disks, etc.), optical media (such as compact discs, digital video discs, Blu-ray discs, etc.), semiconductor media (such as flash memory, electrically programmable read only memory (EPROM), electrically erasable programmable read only memory (EEPROM), etc.), any suitable media that is not fleeting or devoid of any semblance of permanence during transmission, and/or any suitable tangible media. As another example, transitory computer readable media can include signals on networks, in wires, conductors, optical fibers, circuits, any suitable media that is fleeting and devoid of any semblance of permanence during transmission, and/or any suitable intangible media.

As used herein, the term mechanism can encompass hardware, software, firmware, a method, a system, a non-transitory computer readable medium, or any suitable combination thereof.

Accordingly, apparatuses and methods for serial sectioning and imaging are provided.

Although the invention has been described and illustrated in the foregoing illustrative embodiments, it is understood that the present disclosure has been made only by way of example, and that numerous changes in the details of implementation of the invention can be made without departing from the spirit and scope of the invention, which is limited only by the claims that follow. Features of the disclosed embodiments can be combined and rearranged in various ways.

What is claimed is:

1. An apparatus for serial sectioning, the apparatus comprising:

a material removal tool moveable on a first axis;

a bed moveable on a second axis and third axis, wherein the first axis and second axis are perpendicular, and wherein the third axis is perpendicular to both the first axis and second axis;

a linear slide positioned substantially parallel to the first axis;

a guide positioned substantially parallel to the first axis;

a mounting block configured to be coupled to an imaging device, the mounting block coupled to the linear slide using one or more carriages;

an armature coupled to the material removal tool and the guide, such that the guide moves along a direction parallel to the first axis in a fixed relationship with the material removal tool;

a locking device that fixes a position of the mounting block at a particular location along the length of the guide; and a hardware processor that is configured to:

(a) cause the bed to be moved to a material removal position in a plane defined by the second axis and third axis;

(b) cause the material removal tool to remove a first predetermined thickness of a sample mounted to the sample table along the first axis;

(c) cause the bed to be moved to an imaging position in the plane defined by the first axis and second axis such that the center of the bed is located at a predetermined location with respect to the mounting block; and (d) repeating (a) through (c) until a second predetermined thickness of the sample has been removed.

2. The apparatus of claim 1, further comprising a camera housing coupled to mounting block, wherein the camera housing is configured to accept a macroscopic objective lens.

3. The apparatus of claim 2, wherein the focal length of the objective lens is in the range of 70 mm to 120 mm.

4. The apparatus of claim 2, wherein the imaging, device includes at least one of a visible light imager, an X-ray fluorescence-based imager, an X-ray diffraction-based imager, a cathodluminescence-based imager, an, infrared imager, a gamma radiation-based imager, and an alpha radiation-based imager.

5. The apparatus of claim 1, further comprising a lighting stage coupled to armature such that a position of the lighting stage is fixed in relation to the material removal tool along a direction of the first axis.

6. The apparatus of claim 1, wherein the system further comprises a sample preparation area comprising a compressed air nozzle, a liquid misting nozzle, and a pneumatic wiper;

and wherein the hardware processor is further configured to:

move the bed to the sample preparation area;

cause compressed air to be applied to the sample using the compressed air nozzle;

cause liquid to be applied to the sample using the misting nozzle; and cause the pneumatic wiper to be lowered to a predetermined position while the bed is moved in proximity to the wiper.

7. The apparatus of claim 1, wherein the camera housing further comprises a barrier, and wherein the hardware processor is further configured to cause the barrier of the camera housing to open such that an objective lens of a camera mounted in the camera housing is exposed upon the hardware processor determining that the bed is at the imaging position.

8. The apparatus of claim 1, wherein the tool further comprises a grinding wheel.

9. The apparatus of claim 1, further comprising an adjustment screw that causes a position of the armature along the first axis to be changed in response to the screw being turned.

10. The apparatus of claim 9, wherein the adjustment screw is configured to make fine adjustments in the position of the armature along the first axis.

11. The apparatus of claim 1, wherein the hardware processor is further configured to cause the imaging device to capture an image upon determining that the bed is located at the predetermined location.

12. A method for serial sectioning, the method comprising:

(a) fixing a position of an imaging device along a first axis defined by a guide based on a working distance of the imaging device, wherein the guide is coupled to a material removal tool;

(b) fixing a distance between the imaging device and a surface of a sample;

(c) causing, using at least one hardware processor, the sample to be moved to a material removal position in a plane defined by a second axis and a third axis that are both perpendicular to the first axis;

(d) causing, using the at least one hardware processor, the material removal tool to remove a first predetermined thickness of the sample along a first axis direction;

(e) causing, using the at least one hardware processor, the sample stage to be moved to an imaging position in the plane defined by the second axis and third axis such that the center of the sample is located at a predetermined location with respect to the imaging device;

(f) causing, using the at least one hardware processor, the imaging device to capture an image of a newly revealed surface of the sample;

(g) repeating (c) through (f) until a second predetermined thickness of the sample has been removed in the first axis direction.

13. The method of claim 11, wherein the imaging device is configured to use a macroscopic objective lens.

14. The method of claim 12, wherein the focal length of the objective lens is in the range of 70 mm to 120 mm.

15. The method of claim 13, wherein causing the image device to capture an image comprises causing the imaging device to capture an image using at least one of the following: a visible light imager, an X-ray fluorescence-based imager, an X-ray diffraction-based imager, a cathodluminescence-based imager, an infrared imager, a gamma radiation-based imager, and an alpha radiation-based imager.

16. The method of claim 12, further comprising:

causing, using the at least one hardware processor, the sample to be moved to a sample preparation area;

causing, using the at least one hardware processor, a compressed air nozzle to apply compressed air to a surface of the sample;

causing, using the hardware processor, a misting nozzle to apply liquid to a surface of the sample; and causing, using the hardware processor, a pneumatic wiper to be applied to a surface of the sample.

17. The method of claim 12, further comprising causing, using the hardware processor, a barrier of a camera housing to open such that the objective lens is exposed upon the determining, using the hardware processor, that the sample is at the imaging position.

18. The method of claim 12, wherein the material removal tool further comprises a grinding wheel.

19. The method of claim 12, wherein fixing a distance between the imaging device and the surface of a sample comprises turning an adjustment screw that causes a position of the imaging device along the first axis direction to be changed.

20. The method of claim 19, wherein the adjustment screw is configured to make fine adjustments in the position of the armature along the third axis.

* * * * *

UNITED STATES PATENT AND TRADEMARK OFFICE

CERTIFICATE OF CORRECTION

PATENT NO. : 9,233,453 B1
APPLICATION NO. : 13/841933
DATED : January 12, 2016
INVENTOR(S) : Bradley Samuels et al.

It is certified that error appears in the above-identified patent and that said Letters Patent is hereby corrected as shown below:

Claims

Claim 4, line 1, “wherein the imaging, device” should be -- wherein the imaging device --.

Claim 4, line 4, “an, infrared imager,” should be -- an infrared imager, --.

Signed and Sealed this
Nineteenth Day of April, 2016

Michelle K. Lee

Michelle K. Lee
*Director of the United States Patent and Trademark Office*